US012084940B2

(12) United States Patent
Bushman et al.

(10) Patent No.: US 12,084,940 B2
(45) **Date of Patent: *Sep. 10, 2024**

(54) SYSTEMS AND METHODS FOR DEPLOYMENT OF A FRAC BALL INTO A WELLBORE

(71) Applicant: CACTUS WELLHEAD, LLC, Houston, TX (US)

(72) Inventors: Jerod Bushman, Tomball, TX (US); Brenton Greska, Katy, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/230,038

(22) Filed: Aug. 3, 2023

(65) Prior Publication Data

US 2023/0374879 A1 Nov. 23, 2023

Related U.S. Application Data

(63) Continuation of application No. 17/473,735, filed on Sep. 13, 2021, now Pat. No. 11,753,896.

(60) Provisional application No. 63/078,640, filed on Sep. 15, 2020.

(51) Int. Cl.
*E21B 33/068* (2006.01)
*E21B 34/02* (2006.01)
*E21B 43/26* (2006.01)

(52) U.S. Cl.
CPC ..... *E21B 33/068* (2013.01); *E21B 34/02* (2013.01); *E21B 43/2607* (2020.05)

(58) Field of Classification Search
CPC ..... E21B 33/068; E21B 34/02; E21B 43/2607
See application file for complete search history.

(56) References Cited

U.S. PATENT DOCUMENTS

| | | | | |
|---|---|---|---|---|
| 3,000,028 | A * | 9/1961 | Buie | F16L 55/46 15/104.062 |
| 3,028,996 | A * | 4/1962 | Ellett | F16L 55/46 15/104.062 |
| 3,146,477 | A * | 9/1964 | Bergman | F16L 55/46 15/104.062 |
| 4,132,243 | A * | 1/1979 | Kuus | E21B 33/068 15/104.062 |
| 6,302,199 | B1 * | 10/2001 | Hawkins | E21B 33/068 166/70 |
| 7,537,052 | B2 * | 5/2009 | Robichaux | E21B 33/068 166/386 |
| 7,552,763 | B2 * | 6/2009 | Claxton | F16L 55/46 166/70 |
| 9,228,417 | B2 * | 1/2016 | McGuire | E21B 43/00 |

(Continued)

*Primary Examiner* — Daniel P Stephenson
(74) *Attorney, Agent, or Firm* — Ewing & Jones, PLLC

(57) ABSTRACT

A ball dropper assembly includes a main body, a sealing piston, and a magazine assembly. The main body includes a main bore, angle bore, and transverse bore formed therethrough. The transverse bore is fluidly coupled to the main bore through the angle bore. The sealing piston is positioned within the transverse bore. Seal rings are positioned between the main body and the sealing piston on either side of the angle bore. The magazine assembly includes a magazine body and a carrier piston. The magazine body is mechanically coupled to the main body. The carrier piston has a carrier hole formed therein and is mechanically coupled to the sealing piston.

18 Claims, 9 Drawing Sheets

(56) References Cited

U.S. PATENT DOCUMENTS

| | | | | |
|---|---|---|---|---|
| 10,161,218 | B2 * | 12/2018 | Allen | E21B 34/02 |
| 10,378,302 | B2 * | 8/2019 | Sinkewich | E21B 33/068 |
| 11,002,101 | B2 * | 5/2021 | Golinowski | E21B 43/2607 |
| 11,220,878 | B1 * | 1/2022 | Sage | E21B 33/068 |
| 11,280,151 | B2 * | 3/2022 | Cherewyk | E21B 17/1078 |
| 11,753,896 | B2 * | 9/2023 | Bushman | E21B 34/02 166/373 |
| 2008/0053660 | A1 * | 3/2008 | Angman | E21B 19/06 166/373 |
| 2012/0152525 | A1 * | 6/2012 | McGuire | B65D 83/0409 166/193 |
| 2017/0051572 | A1 * | 2/2017 | Penney | E21B 23/08 |
| 2018/0313182 | A1 * | 11/2018 | Cherewyk | E21B 33/068 |
| 2021/0115754 | A1 * | 4/2021 | Triche | E21B 33/068 |
| 2022/0081990 | A1 * | 3/2022 | Bushman | E21B 34/02 |
| 2023/0374879 | A1 * | 11/2023 | Bushman | E21B 34/02 |

* cited by examiner

SYSTEMS AND METHODS FOR DEPLOYMENT OF A FRAC BALL INTO A WELLBORE

CROSS-REFERENCE TO RELATED APPLICATIONS

This application continuation application which claims priority from U.S. utility application Ser. No. 17/473,735, filed Sep. 13, 2021, which is itself a nonprovisional application which claims priority from U.S. provisional application No. 63/078,640, filed Sep. 15, 2020, the entirety of which is hereby incorporated by reference.

TECHNICAL FIELD/FIELD OF THE DISCLOSURE

The present disclosure relates to fracking equipment.

BACKGROUND OF THE DISCLOSURE

During frac operations, a frac ball or plug may be dropped or launched into a wellbore to isolate already fracked portions of the well from those that are to be fracked. Conventionally, a frac ball or plug is dropped manually by shutting down frac operations and bringing a worker into the hazardous zone surrounding the wellhead. The worker dismantles top connections and drops the frac ball into the frac tree that is installed on the wellhead. The frac ball lands on the closed portion of the crown valve. The worker reassembles the top connections and exits the hazardous zone. Frac operations work the crown valve and master valve(s) to allow the frac ball to drop into the wellbore. This process may be dangerous for the worker and a source of nonproductive time.

SUMMARY

The present disclosure provides for a ball dropper assembly. The ball dropper assembly may include a main body, the main body having a main bore, angle bore, and transverse bore formed therethrough. The transverse bore may be fluidly coupled to the main bore through the angle bore. The ball dropper assembly may include a sealing piston. The ball dropper assembly may include a magazine assembly including a magazine body and a carrier piston. The magazine body may be mechanically coupled to the main body. The carrier piston may have a carrier hole formed therein. The carrier piston may be mechanically coupled to the sealing piston.

The present disclosure also provides for a method. The method may include coupling a main body of a ball dropper assembly to a wellhead, the main body having a main bore, angle bore, and transverse bore formed therethrough, the transverse bore fluidly coupled to the main bore through the angle bore. The method may include positioning a frac ball within a magazine assembly of the ball dropper assembly. The method may include extending a sealing piston operatively coupled to the actuator at least partially into the transverse bore, the sealing piston coupled to a carrier piston, the carrier piston including a carrier hole. The method may include aligning the carrier hole with the frac ball, dropping the frac ball into the carrier hole, and retracting the sealing piston at least partially from the transverse bore until the carrier hole is positioned within the transverse bore and aligned with the angle bore. The method may include dropping the frac ball into the main bore via the angle bore.

The present disclosure also provides for a valve tree for a wellhead. The valve tree may include one or more valves coupled to the wellhead. The valve tree may also include a ball dropper assembly. The ball dropper assembly may include a main body. The main body may have a main bore, angle bore, and transverse bore formed therethrough. The transverse bore may be fluidly coupled to the main bore through the angle bore. The ball dropper assembly may include an actuation assembly. The actuation assembly may include a sealing piston spacer, the sealing piston spacer being tubular and coupled to the main body aligned with the transverse bore. The actuation assembly may include a sealing piston, the sealing piston positioned within the sealing piston spacer and slidable relative to the sealing piston spacer. The actuation assembly may include an actuator, the actuator operatively coupled to the sealing piston and the sealing piston spacer. The ball dropper assembly may include a magazine assembly, the magazine assembly including a magazine body and a carrier piston. The magazine body may be mechanically coupled to the main body. The carrier piston may have a carrier hole formed therein. The carrier piston may be slidable relative to the magazine body. The carrier piston may be mechanically coupled to the sealing piston

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
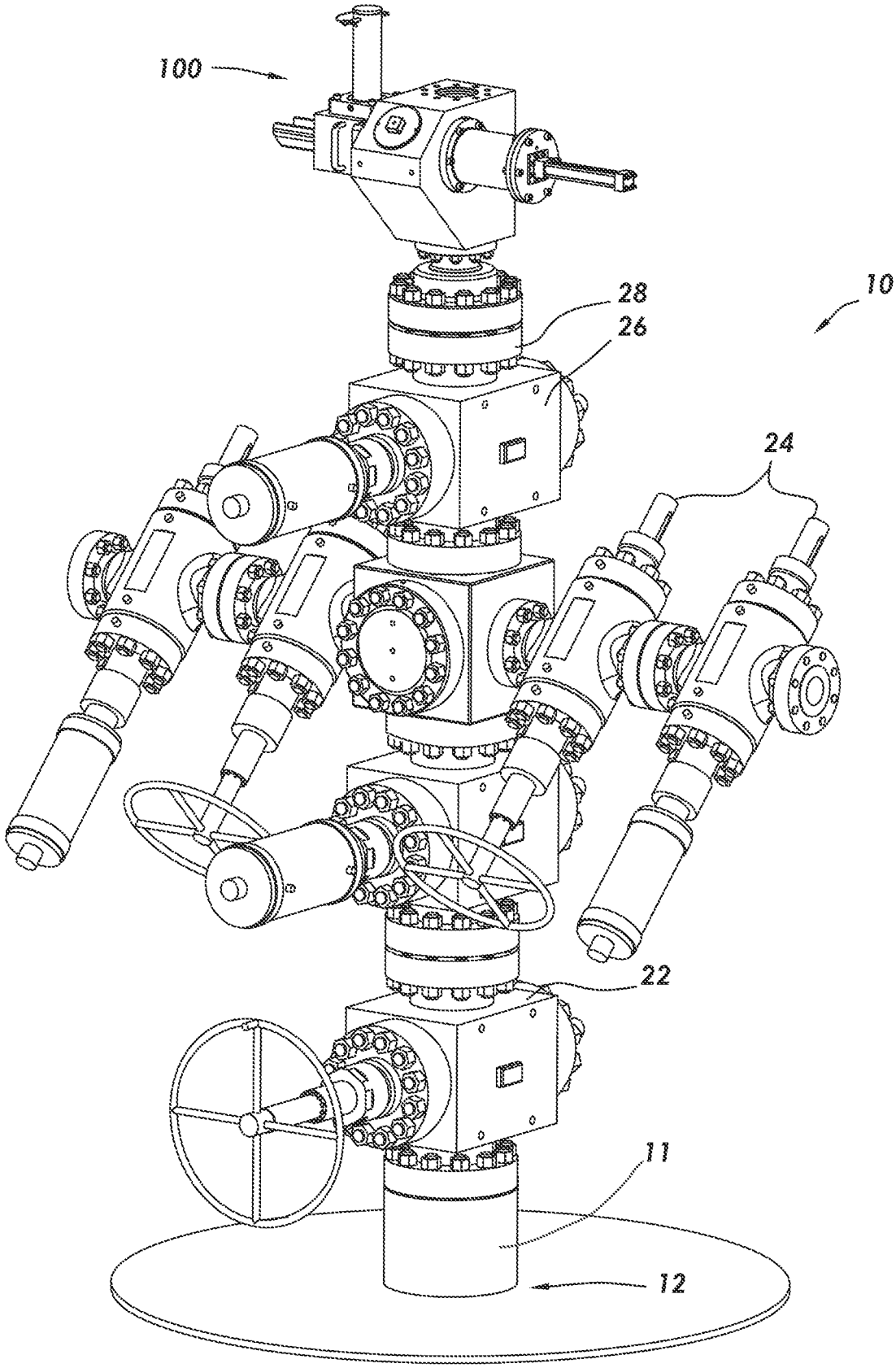
FIG. 1 depicts a perspective view of a wellhead that includes a ball dropper assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts valve tree 10. Valve tree 10 may be coupled to wellhead 11 of wellbore 12. Valve tree 10 may include one or more valves including, for example and without limitation, master valve 22, wing valves 24, and swab valve 26. Valve tree 10 may include upper coupler 28 positioned above swab valve 26. In some embodiments, valve tree 10 may include ball dropper assembly 100. Ball dropper assembly 100 may be mechanically coupled to an upper end of valve tree 10.

In some embodiments, upper coupler 28 may be a flanged connection as shown in FIG. 1 wherein ball dropper assembly 100 is coupled to valve tree 10 using one or more fasteners such as bolts. In other embodiments, upper coupler 28 may include any other suitable connection known in the art including, for example and without limitation, threaded, pinned, breech lock, or other connections. In such embodiments, ball dropper assembly 100 may be mechanically disconnected from a valve tree 10 and coupled to another valve tree 10 as operations requiring ball dropper assembly 100 are performed on each corresponding wellbore.

Figure 9:
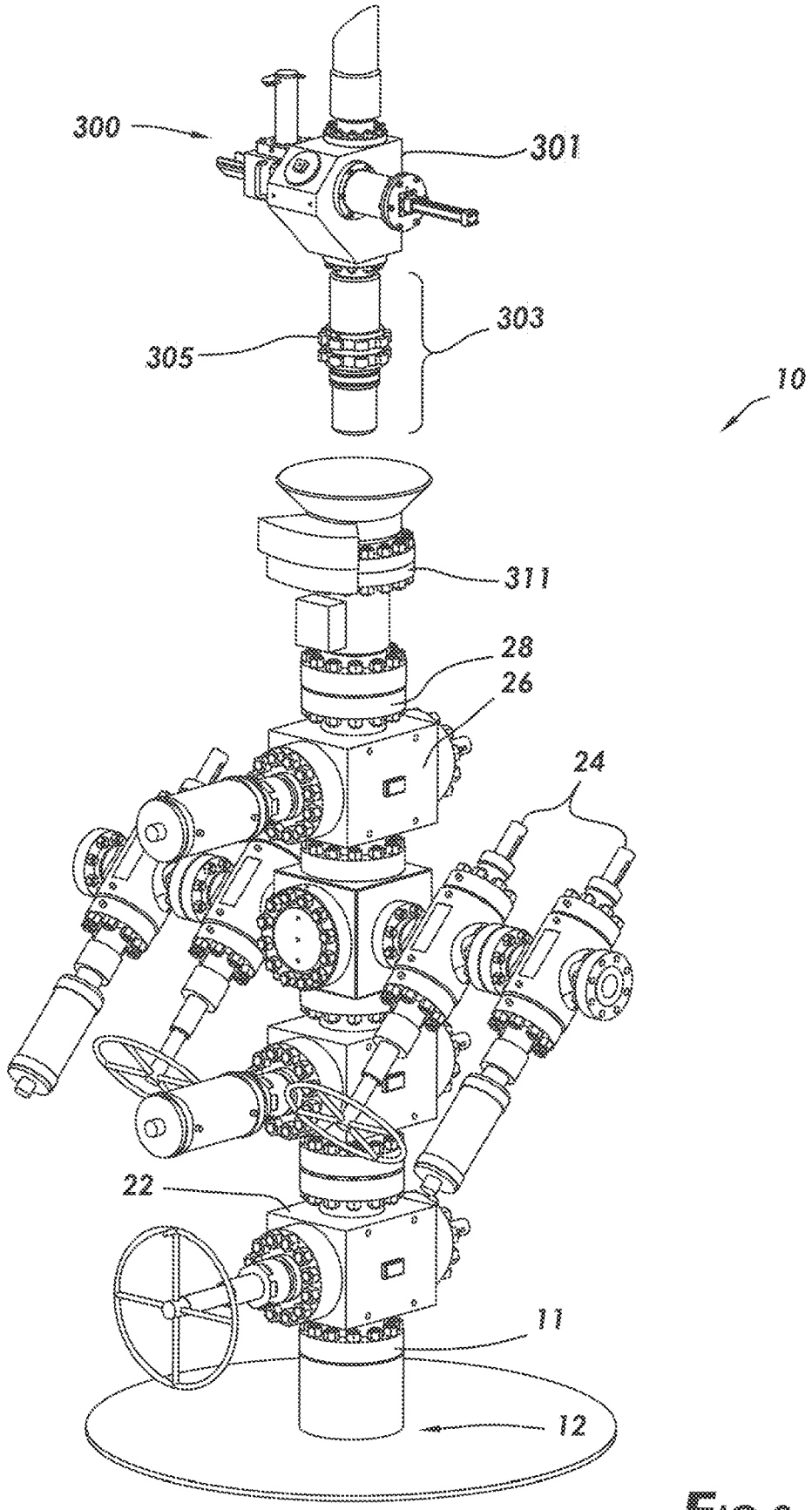
FIG. 9 depicts a perspective view of a wellhead that includes a ball dropper assembly consistent with at least one embodiment of the present disclosure.

In some embodiments, as shown in FIG. 9, ball dropper assembly 300 may include breech pin 303 coupled to a lower end of main body 301 of ball dropper assembly 300. Valve tree 10 may include breech lock base assembly 311. Breech pin 303 may be configured such that breech pin 303 of ball dropper assembly 300 may be longitudinally inserted into breech lock base assembly 311 and retained thereto by engaging one or more breech pin teeth 305 formed on breech pin 303. In such an embodiment, ball dropper assembly 300 may be mechanically disconnected from valve tree 10 and coupled to another valve tree 10 that also includes breech lock base assembly 311, thereby allowing repeatable connections and disconnections between ball dropper assembly 300 and valve trees 10 as operations requiring ball dropper assembly 300 are performed on each corresponding wellbore.

Figure 2:
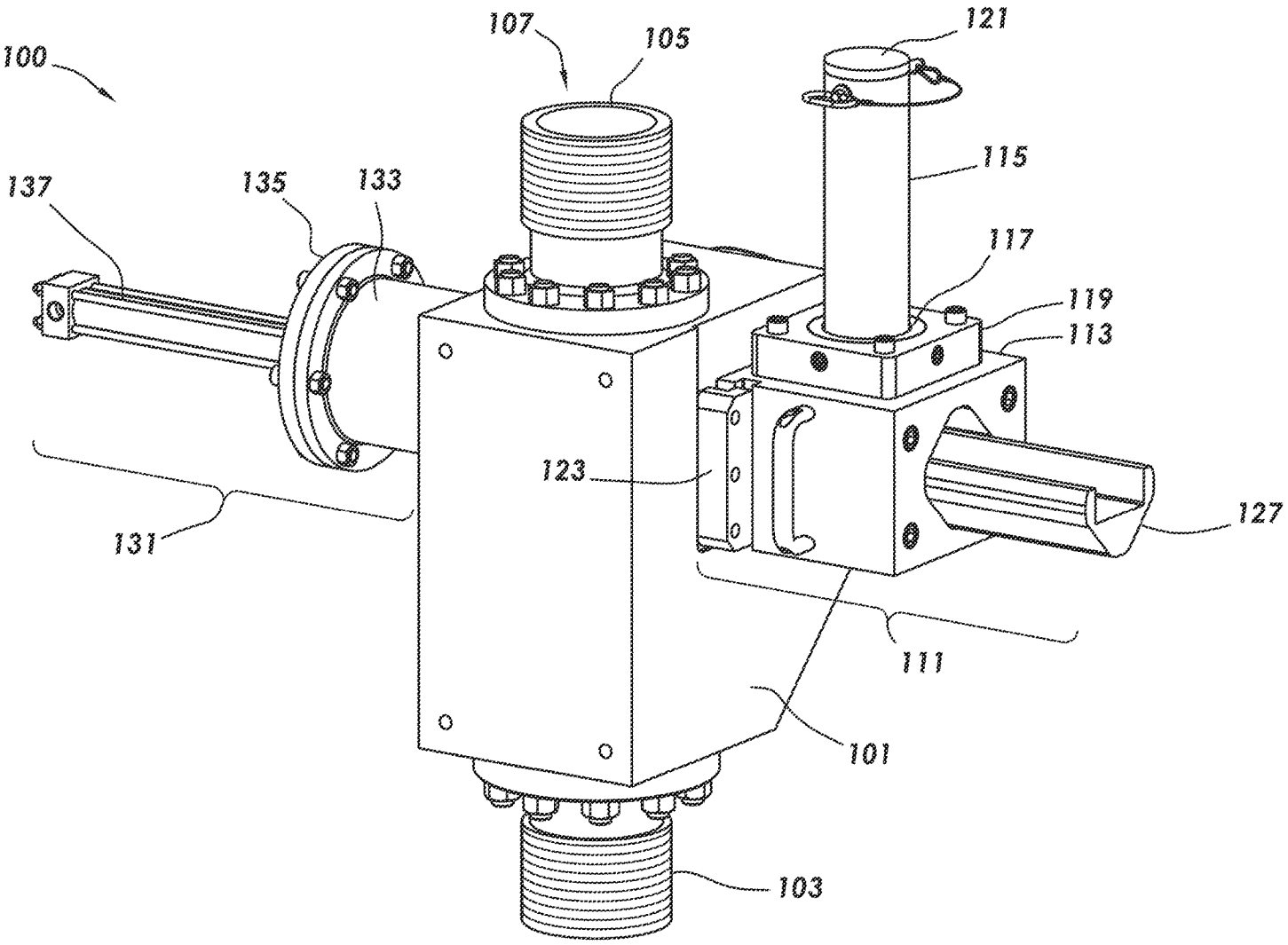
FIG. 2 depicts a perspective view of a ball dropper assembly consistent with at least one embodiment of the present disclosure.
Figure 3:
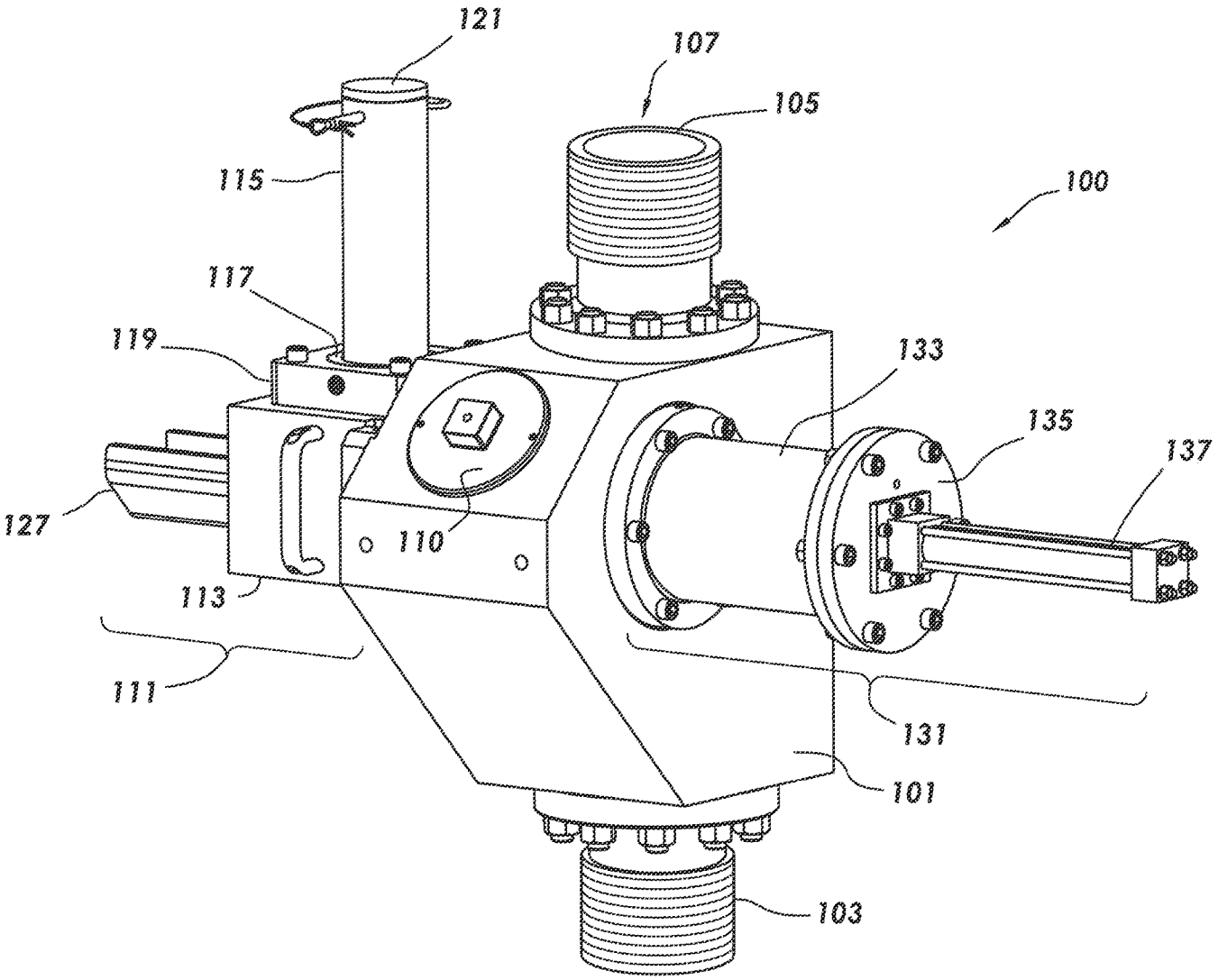
FIG. 3 depicts a perspective view of the ball dropper assembly of FIG. 2.
Figure 4:
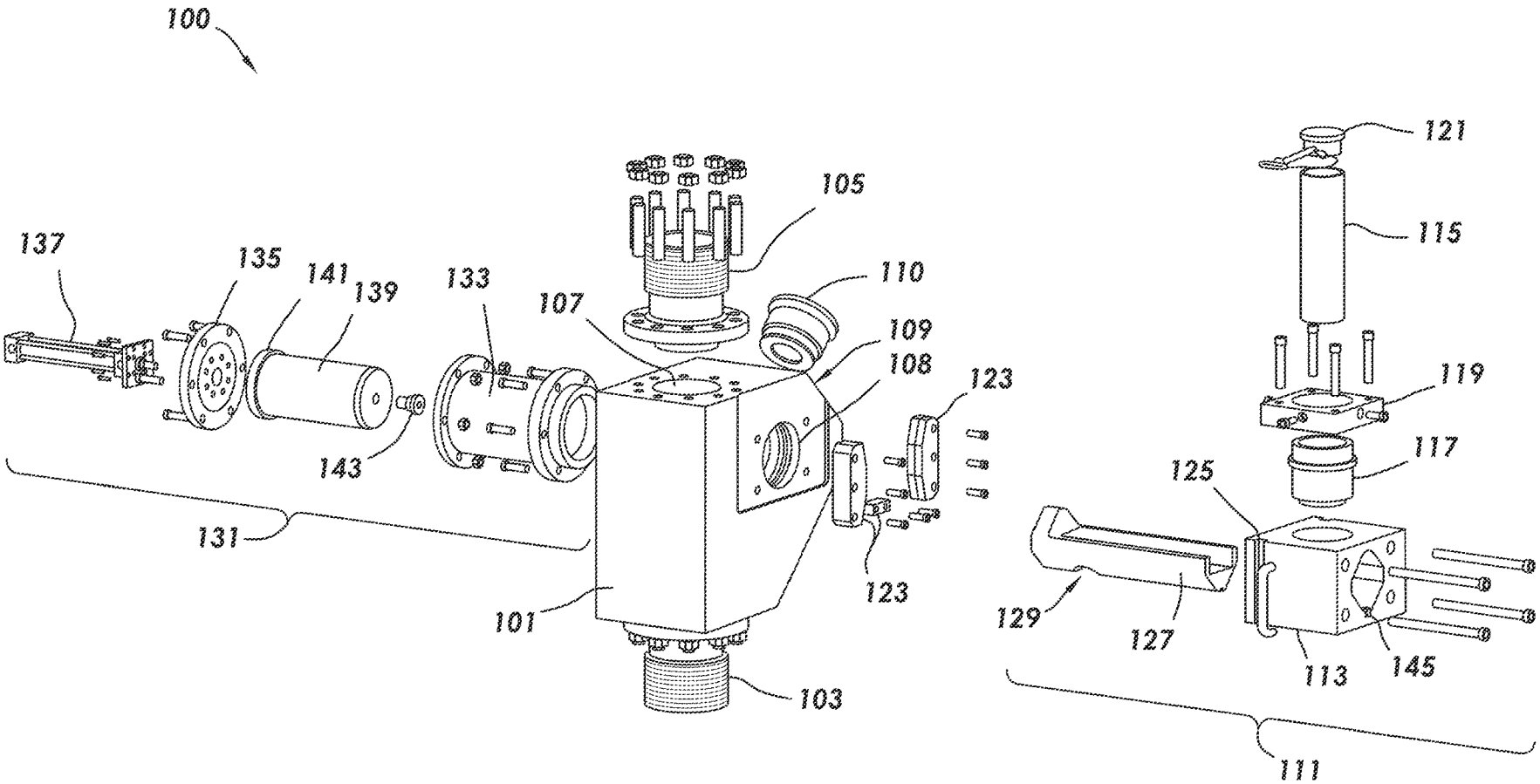
FIG. 4 depicts an exploded view of the ball dropper assembly of FIG. 2.

With reference to FIGS. 2-4, in some embodiments, ball dropper assembly 100 may include main body 101. Main body 101 may include lower adapter 103 and upper adapter 105, which may be used to couple main body 101 to other equipment of valve tree 10. In some embodiments, lower adapter 103 and upper adapter 105 may be threaded couplers. In some embodiments, lower adapter 103 and upper adapter 105 may be fluidly coupled through a bore formed through main body 101, defined herein as main bore 107. In some embodiments, main body 101 may include transverse bore 108 formed in main body 101. In some embodiments, transverse bore 108 may be formed such that transverse bore 108 does not intersect main bore 107. In some embodiments, main body 101 may further include angle bore 109 formed in main body 101 such that angle bore 109 intersects and is fluidly coupled to both main bore 107 and transverse bore 108. In some embodiments, ball dropper assembly 100 may include body plug 110. Body plug 110 may be coupled to main body 101 within angle bore 109 and may cap the end of angle bore 109 opposite main bore 107.

In some embodiments, ball dropper assembly 100 may include magazine assembly 111. Magazine assembly 111 may include magazine body 113, which may mechanically couple to main body 101. In some embodiments, magazine assembly 111 may include magazine tube 115. Magazine tube 115 may be mechanically coupled to magazine body 113 and may extend substantially upward. As further described herein below, magazine tube 115 may hold one or more frac balls 201 (as shown in, for example, FIGS. 5-7) prior to the introduction of frac balls 201 into wellbore 12. In some embodiments, magazine tube 115 may hold frac balls 201 of different sizes such as would be used during sequential fracking operations. In some embodiments, magazine tube 115 may couple to magazine body 113 using one or more adapters such as, for example and without limitation, magazine tube adapter 117 and magazine tube mount 119. In some embodiments, magazine tube adapter 117 may couple between magazine tube 115 and magazine body 113 and provide a bore through which frac balls 201 may pass when moving between magazine tube 115 and magazine body 113 as further described below. Magazine tube mount 119 may, in some embodiments, support magazine tube 115 and provide for mechanical coupling between magazine tube 115 and magazine body 113. In some embodiments, by using different sizes or configurations of magazine tube 115 and magazine tube adapter 117, ball dropper assembly 100 may be used with different size frac balls 201 while using the same magazine body 113 and magazine tube mount 119. In such embodiments, by changing magazine tube 115, operation of ball dropper assembly 100 can be interchanged between frac balls 201 of different size or other devices including, for example and without limitation, plugs, or spherical or tubular frac plugs. In some embodiments, magazine assembly may include magazine tube lid 121. Magazine tube lid 121 may couple to the upper end of magazine tube 115 and may, for example and without limitation, retain frac balls 201 within magazine tube 115.

In some embodiments, magazine assembly 111 may be decoupled from main body 101 as a single, assembled unit to allow magazine assembly 111 to be replaced with a replacement magazine assembly 111, such as, once all frac balls 201 have been used. In some such embodiments, one or more magazine guides 123 may be coupled to main body 101. Magazine guides 123 may be adapted to engage mounting slots 125 as shown in FIG. 4 formed in magazine body 113 and thereby retain magazine assembly 111 to main body 101.

In some embodiments, magazine assembly 111 may include carrier piston 127 used, as further described herein below, to transfer frac balls 201 from magazine assembly 111 to main bore 107 of main body 101, and thereby into wellbore 12, via angle bore 109. In some embodiments, carrier piston 127 may engage to magazine body 113 or main body 101 such that rotation of carrier piston 127 is reduced or prevented while allowing sliding of carrier piston 127 relative thereto.

In some embodiments, ball dropper assembly 100 may include actuation assembly 131. Actuation assembly 131 may include sealing piston spacer 133. Sealing piston spacer 133 may be tubular and may mechanically couple to main body 101 at a position opposite magazine assembly 111 aligned with transverse bore 108. The interior of sealing piston spacer 133 may be fluidly coupled to transverse bore 108. Sealing piston spacer 133 may fluidly seal against main body 101. In some embodiments, actuation assembly 131 may include spacer cap 135. Spacer cap 135 may be coupled to sealing piston spacer 133.

In some embodiments, actuator 137 may mechanically couple to spacer cap 135. Actuator 137 may be a linear actuator used to operate ball dropper assembly 100 as further described herein below. In some embodiments, for example and without limitation, actuator 137 may include a hydraulic cylinder, pneumatic cylinder, or may include an electromechanical actuator.

As shown in FIG. 4, actuation assembly 131 may include sealing piston 139. Sealing piston 139 may be slidingly positioned within sealing piston spacer 133. In such an embodiment, sealing piston spacer 133 may act as a cylinder through which sealing piston 139 may traverse. In some embodiments, sealing piston 139 may be operatively coupled to actuator 137 such that operation of actuator 137 may move sealing piston 139 linearly relative to sealing piston spacer 133. In some embodiments, actuation assembly 131 may include wear ring 141 positioned between sealing piston 139 and sealing piston spacer 133. In some embodiments, main body 101 may include one or more seal rings 142 positioned to fluidly seal against sealing piston 139. In some embodiments, seal rings 142 may be positioned to seal against sealing piston 139 throughout the full range of motion of sealing piston 139. In some embodiments, seal rings 142 may be positioned on either side of angle bore 109 such that when sealing piston 139 is in the extended position, as discussed below, a retracting force is not applied to sealing piston 139 due to pressure within the wellbore as sealing piston 139 is in a pressure-balanced position.

Figure 5:
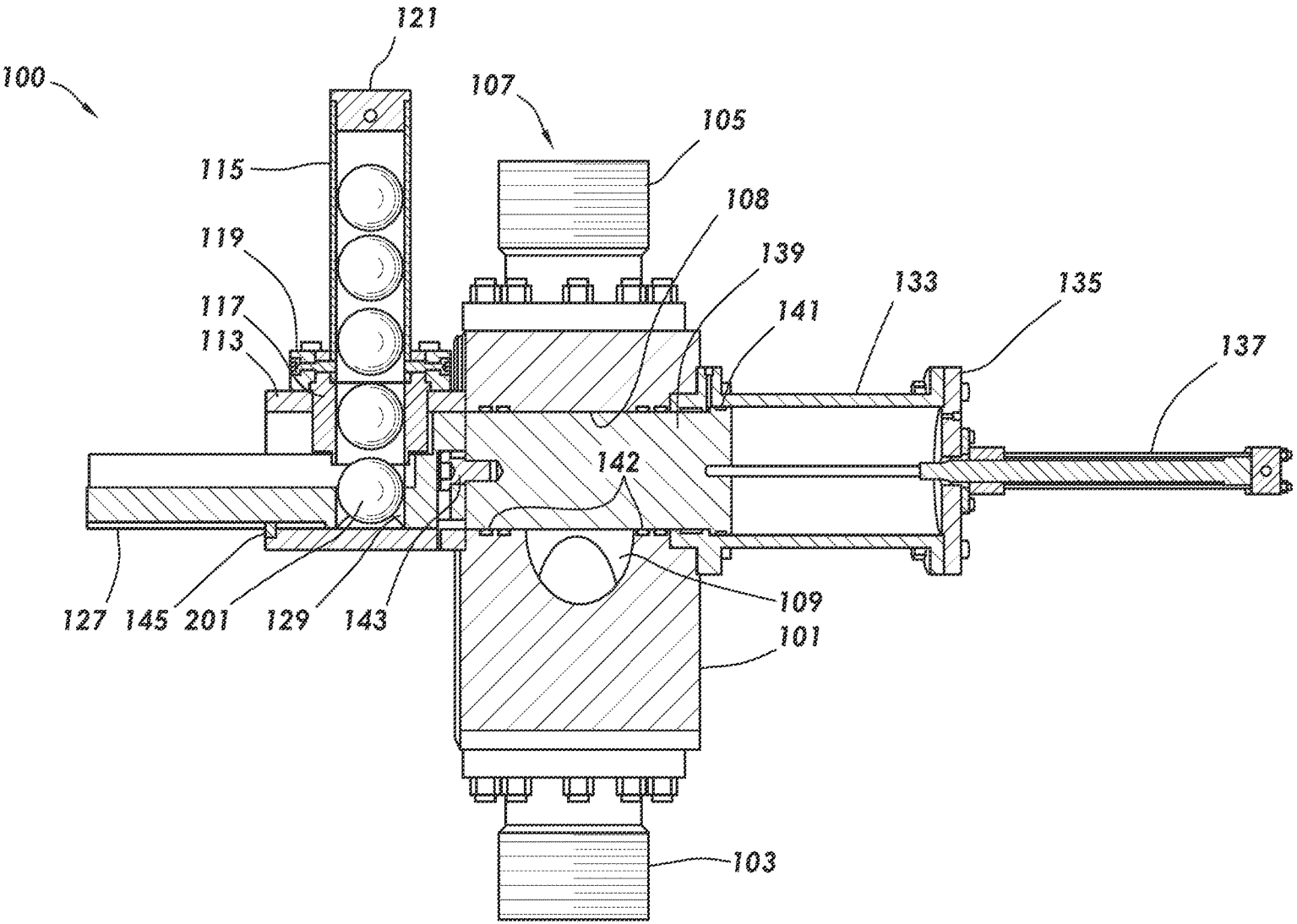
FIGS. 5-7 depict cross section views of a ball dropper assembly during stages of a ball dropping operation consistent with at least one embodiment of the present disclosure.
Figure 6:
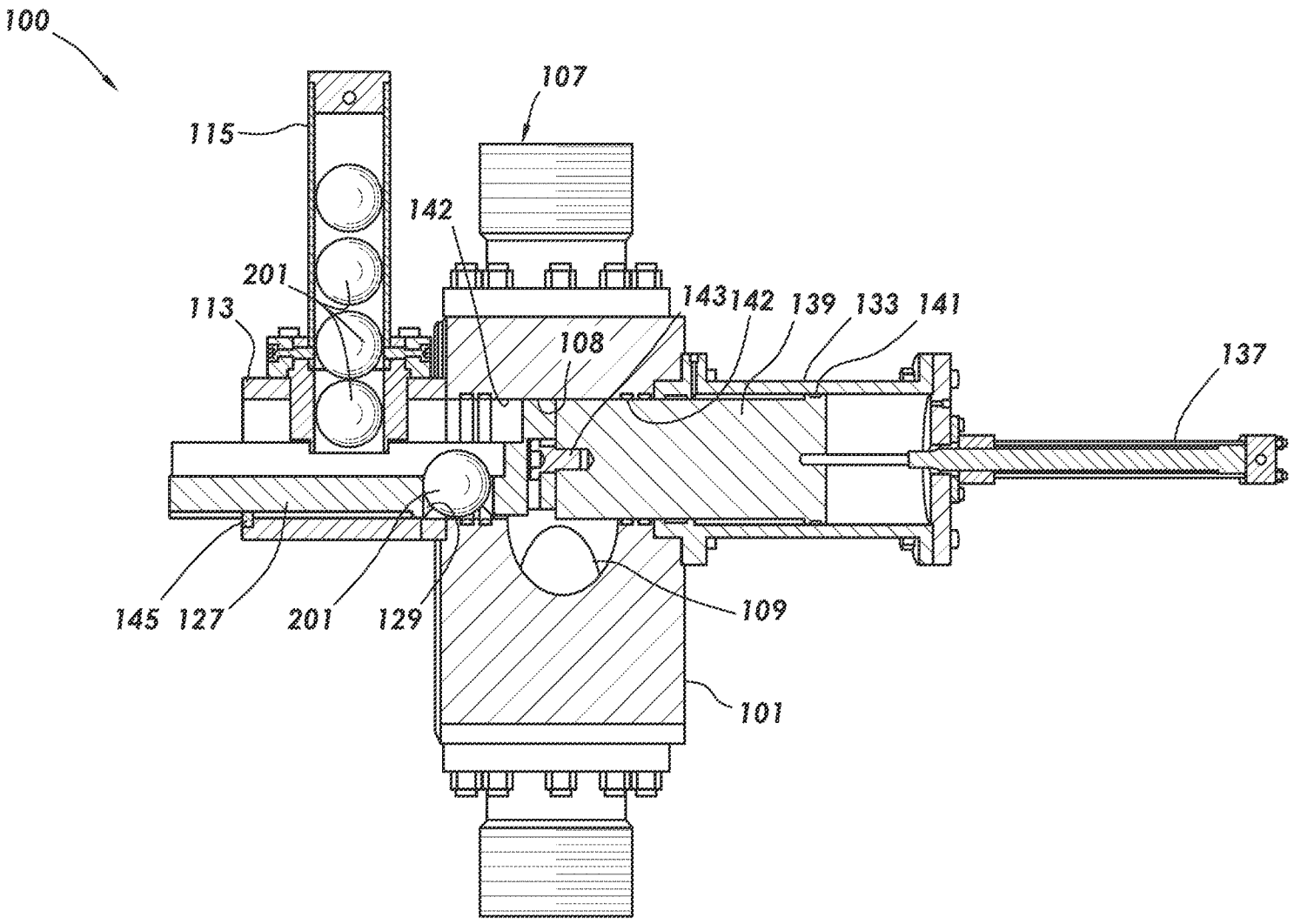
Figure 7:
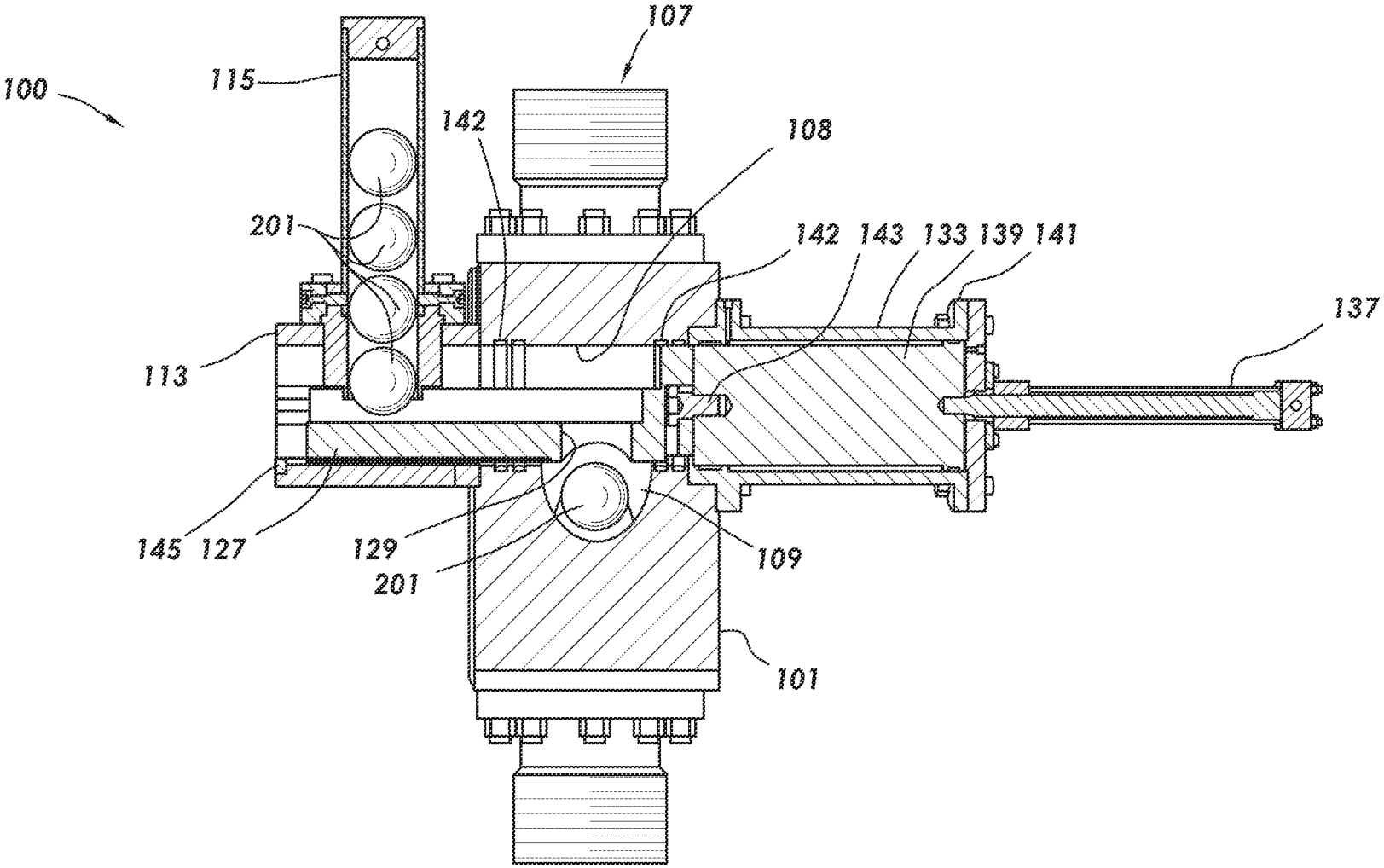

FIGS. 5-7 depict cross section views of ball dropper assembly 100 during a ball drop operation consistent with at least one embodiment of the present disclosure. During such an operation, sealing piston 139 may be moved from an extended position as shown in FIG. 5, through an intermediate position as shown in FIG. 6, and to a retracted position as shown in FIG. 7. In each position, wear ring 141 may be in contact with both sealing piston 139 and sealing piston spacer 133 such that the sealing piston 139 stays centered within the sealing piston spacer 133.

In some embodiments, sealing piston 139 may be mechanically coupled to carrier piston 127 such that carrier piston 127 moves along with sealing piston 139 as actuator 137 is operated. In some such embodiments, sealing piston 139 may be mechanically coupled to carrier piston 127 by fastener 143, which may be a screw, bolt, or other fastener. By coupling sealing piston 139 to carrier piston 127, both sealing and ball dropping operations, as discussed below, may be undertaken by a single actuation of actuator 137.

As shown in FIGS. 5-7, carrier piston 127 may include carrier hole 129. Carrier hole 129 may be formed through carrier piston 127 in a direction perpendicular to the direction of movement of carrier piston 127 and in a direction aligned with magazine tube 115. Carrier hole 129 may be positioned such that carrier hole 129 is aligned with magazine tube 115 when sealing piston 139 is fully extended as shown in FIG. 5, referred to herein as a load position. In some embodiments, when carrier piston 127 is in the load position, the lowermost frac ball 201 within magazine tube 115 may fall into carrier hole 129. Carrier piston 127 may then be moved by retraction of sealing piston 139 as moved by actuator 137 through the intermediate position as shown in FIG. 6. In such a position, carrier piston 127 may retain any further frac balls 201 within magazine tube 115 as the lowermost frac ball 201 is moved into transverse bore 108 of main body 101. Frac ball 201 may be supported by magazine body 113 and by main body 101 as carrier piston 127 moves frac ball 201 into main body 101.

Figure 8:
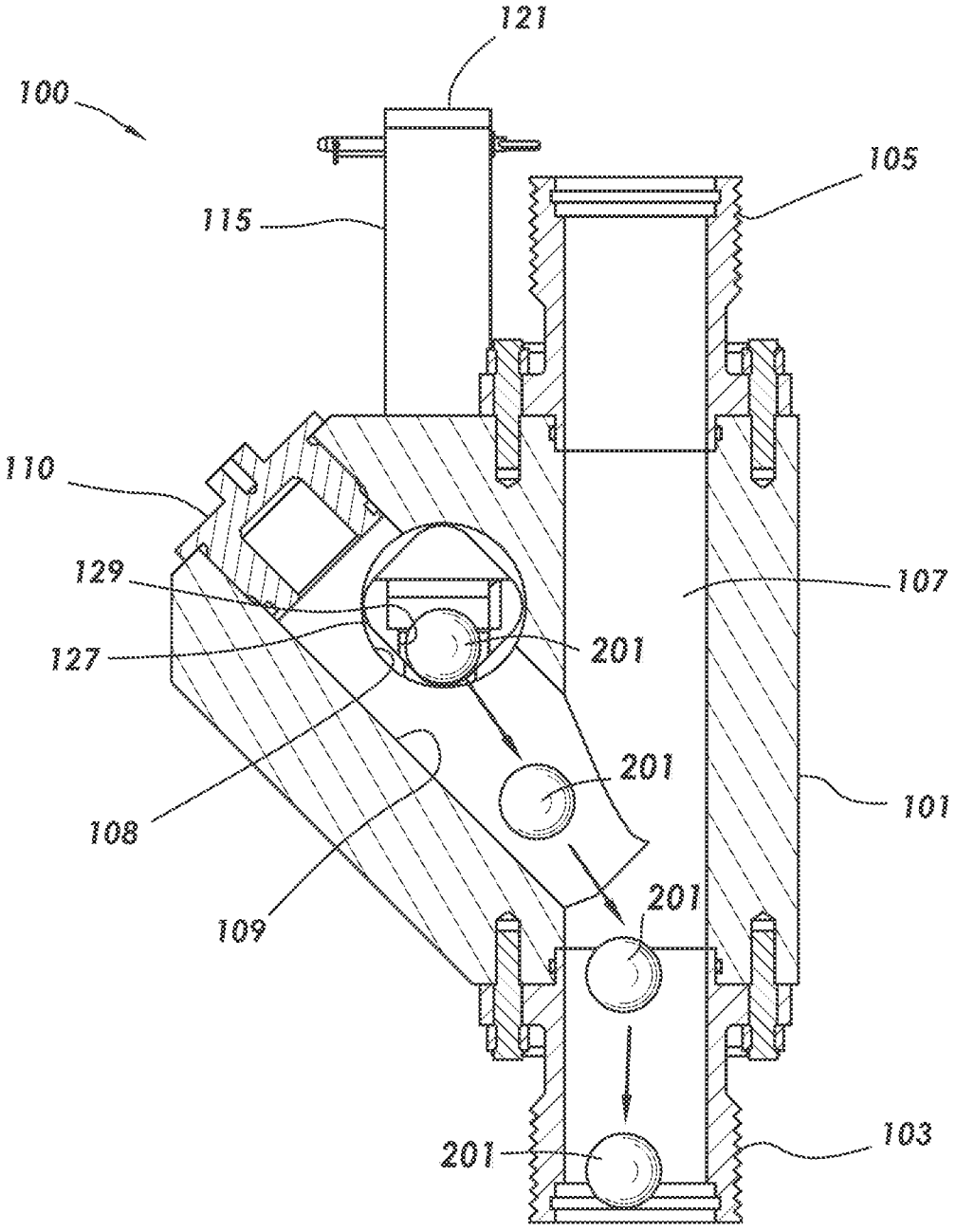
FIG. 8 depicts a cross section view of a ball dropper assembly consistent with at least one embodiment of the present disclosure.

Further movement of carrier piston 127 may bring carrier hole 129 into alignment with angle bore 109 of main body 101 as shown in FIG. 7, referred to herein as the drop position. When in the drop position, because carrier hole 129 is aligned with angle bore 109, frac ball 201 positioned within carrier hole 129 is no longer supported by magazine body 113 or main body 101 as shown in FIG. 8. Frac ball 201 therefore is able to drop into angle bore 109. Frac ball 201 may traverse angle bore 109 into main bore 107 and may continue downward into wellbore 12 via valve tree 10. Carrier piston 127 may then be returned to the load position as depicted in FIG. 5 by action of actuator 137 via sealing piston 139 such that the next frac ball 201 within magazine tube 115 is able to enter carrier hole 129. Thus, for each operation of actuator 137, one frac ball 201 is deployed to wellbore 12 as long as sufficient frac balls 201 remain in magazine tube 115.

In some embodiments, because sealing piston 139 and carrier piston 127 are positioned within transverse bore 108, main bore 107 may not be encumbered by any components of ball dropper assembly 100 and may therefore allow for the full bore diameter to be used by other tools.

In some embodiments, ball dropper assembly 100 may include ball sensor 145 as shown in FIGS. 5-7. Ball sensor 145 may be positioned to detect whether a frac ball 201 is positioned within carrier hole 129. Ball sensor 145 may therefore be used, for example and without limitation, to determine whether frac ball 201 is loaded into carrier hole 129, whether frac ball 201 has been dropped, and whether magazine tube 115 is empty.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A ball dropper system, comprising:

a main body, wherein:

a main bore extends substantially vertically through the main body;

a transverse bore extends transversely through the main body and does not directly intersect with the main bore; and a slanted bore extends within the main body such that the slanted bore intersects with the main bore and the transverse bore;

a magazine assembly, wherein the magazine assembly comprises:

a magazine body mechanically coupled to the main body such that a magazine bore of the magazine body is aligned with the transverse bore of the main body; and a carrier piston having a carrier hole formed therethrough; and an actuation assembly configured to slide the carrier piston within the magazine bore of the magazine body to facilitate transferring a frac ball from the transverse bore of the main body through the slanted bore of the main body to the main bore of the main body, wherein the actuation assembly comprises a sealing piston mechanically coupled to the carrier piston of the magazine assembly;

wherein the magazine assembly and the actuation assembly are disposed on opposite sides of the main body.

2. The ball dropper system of claim 1, wherein a proximal end of the carrier piston nearer the sealing piston has the carrier hole and a distal end of the carrier piston retains the frac ball in a magazine tube of the magazine assembly.

3. The ball dropper system of claim 1, wherein a distal end of the carrier piston extends outside of both the main body and the magazine body in an extended position of the actuation assembly.

4. The ball dropper system of claim 1, wherein the magazine assembly further comprises: a magazine tube and a magazine tube adapter that is coupled between the magazine tube and the magazine body, the magazine tube and magazine tube adapter replaceable with different sizes to be used with different sizes of the frac ball.

5. The ball dropper system of claim 1, further comprising a first seal ring positioned between the sealing piston and the main body on a first side of the slanted bore and a second seal ring positioned between the sealing piston and the main body on a second side of the slanted bore.

6. The ball dropper system of claim 1, further comprising a magazine guide coupled to the main body, wherein the magazine body comprises a mounting slot engaging the magazine guide to couple the magazine body to the main body.

7. The ball dropper system of claim 1, wherein the slanted bore is capped with a plug at an end of the slanted bore opposite the main bore.

8. The ball dropper system of claim 1, wherein the slanted bore is capped with a plug at an end of the slanted bore opposite the main bore and an upper end of a magazine tube of the magazine assembly includes a lid.

9. A method, comprising:

coupling a main body of a ball dropper assembly to a wellhead, wherein:

a main bore extends substantially vertically through the main body;

a transverse bore extends transversely through the main body and does not directly intersect with the main bore; and a slanted bore extends within the main body such that the slanted bore intersects with the main bore and the transverse bore;

positioning a frac ball within a magazine assembly of the ball dropper assembly;

extending a sealing piston operatively coupled to an actuator at least partially into the transverse bore, the sealing piston coupled to a carrier piston, the carrier piston including a carrier hole aligned with the frac ball to drop the frac ball into the carrier hole due to the extending of the sealing piston; and retracting the sealing piston at least partially from the transverse bore until the carrier hole is positioned within the transverse bore and aligned with the slanted bore thereby transferring the frac ball from the transverse bore of the main body through the slanted bore of the main body to the main bore of the main body;

wherein at least one of the carrier piston and the sealing piston remain within the slanted bore throughout the extending and the retracting.

10. The method of claim 9, wherein a proximal end of the carrier piston nearer the sealing piston has the carrier hole and a distal end of the carrier piston retains the frac ball in a magazine tube of the magazine assembly.

11. The method of claim 9, wherein a distal end of the carrier piston extends outside of the main body upon the extending of the sealing piston.

12. The method of claim 9, wherein a first seal ring is positioned between the sealing piston and the main body on a first side of the slanted bore and a second seal ring is positioned between the sealing piston and the main body on a second side of the slanted bore.

13. The method of claim 9, wherein the extending and the retracting are accomplished by operating an actuator disposed on an opposite side of the main body from the magazine assembly.

14. The method of claim 9, further comprising replacing the magazine assembly with another preloaded assembly once the magazine assembly is empty.

15. The method of claim 9, further comprising replacing within the magazine assembly a magazine tube and a magazine tube adapter with different sizes to be used with different sizes of the frac ball.

16. The method of claim 9, wherein the slanted bore is capped with a plug at an end of the slanted bore opposite the main bore and positioning the frac ball within the magazine assembly is accomplished without removing the plug.

17. A method, comprising:

coupling a main body of a ball dropper assembly to a wellhead, wherein:

a main bore extends substantially vertically through the main body;

a transverse bore extends transversely through the main body and does not directly intersect with the main bore; and a slanted bore extends within the main body such that the slanted bore intersects with the main bore and the transverse bore and is capped with a plug at an end of the slanted bore opposite the main bore;

positioning a frac ball within a magazine assembly of the ball dropper assembly; and actuating the magazine assembly to perform a ball drop operation without removing the plug, wherein the frac ball passes along the transverse bore of the main body entering along a length of the slanted bore of the main body where the transverse bore and the slanted bore intersect and then passes along the slanted bore to the main bore of the main body; and replacing the magazine assembly with another preloaded assembly.

18. The method of claim 17, wherein the actuating occurs from an opposite side of the main body from where the magazine assembly is coupled to the main body.

* * * * *